United States Patent [19]

Markley

[11] Patent Number: 4,973,396

[45] Date of Patent: Nov. 27, 1990

[54] METHOD OF PRODUCING SWEET FEED IN LOW PRESSURE HYDROTREATERS

[75] Inventor: Gerald E. Markley, Baton Rouge, La.

[73] Assignee: Exxon Research and Engineering Company, Florham Park, N.J.

[21] Appl. No.: 378,335

[22] Filed: Jul. 10, 1989

[51] Int. Cl.[5] ..... C10G 69/10; C10G 65/04

[52] U.S. Cl. ..... 208/89; 208/57; 208/92; 208/210; 208/217; 208/216 R

[58] Field of Search ..... 208/89, 57, 92, 78, 208/210, 216 R, 217

[56] References Cited

U.S. PATENT DOCUMENTS

| | | | |
|---|---|---|---|
| 3,184,402 | 5/1965 | Kozlowski et al. | 208/59 |
| 3,240,694 | 3/1966 | Mason et al. | 208/59 |
| 3,779,897 | 12/1973 | Wrench et al. | 208/89 |
| 3,816,296 | 6/1974 | Hass et al. | 208/59 |
| 3,869,378 | 3/1975 | Pollock et al. | 208/78 |
| 3,873,442 | 3/1975 | Yarrington | 288/112 |
| 4,082,647 | 4/1978 | Hutchings et al. | 208/78 |
| 4,298,458 | 11/1981 | Banta et al. | 288/89 |
| 4,755,280 | 7/1988 | Hudson et al. | 208/89 |
| 4,756,822 | 7/1988 | Chen et al. | 288/111 |
| 4,780,193 | 10/1988 | Derr, Jr. et al. | 208/57 |
| 4,789,457 | 12/1988 | Fischer et al. | 208/68 |

*Primary Examiner*—Anthony McFarlane

*Attorney, Agent, or Firm*—Chris P. Konkol

[57] ABSTRACT

Hydrotreating at relatively low pressure and elevated temperature followed by a selective distillation results in lighter fractions substantially free of sulfur and nitrogen. Over half of the total liquid product is suitable for sweet hydroprocessing over a noble metal catalyst.

12 Claims, 3 Drawing Sheets

METHOD OF PRODUCING SWEET FEED IN LOW PRESSURE HYDROTREATERS

This invention relates to a hydrotreating process. More particularly, this invention relates to hydrotreating a feedstock at relatively low pressure followed by a selective distillation to obtain an effluent suitable for hydroprocessing or hydrocracking over a noble metal containing catalyst.

Hydrotreating is used to improve the quality of petroleum feedstocks by treating the same with hydrogen in the presence of a catalyst. Depending on the precise feed and the purpose of the operation, hydrotreating can markedly improve the odor, color, stability, reaction characteristics and other important quality characteristics of the feed. Hydrotreating is capable of removing sulfur, nitrogen and other nonhydrocarbon components.

Severe hydrotreating is presently used to prepare hydrocracking feedstocks. Hydrocracking is known to significantly improve both distillate and naphtha product quality. Burning qualities are improved and gasoline yield is increased.

The hydrocracking process consists primarily of a high activity noble metal catalyst which saturates aromatics to low levels or causes significant conversion to naphtha. In order to function properly, this catalyst must operate on a "sweetened" process stream, that is one where sulfur and nitrogen have been removed to very low levels. For acceptable conversion activity, sulfur and nitrogen should be typically reduced to levels of 40 ppm and 10 ppm, respectively, or lower. Some commercial units occasionally operate to levels slightly above this range, but must increase temperature in the conversion reactor to compensate for the lower catalyst activity. For acceptable hydrogenation activity, still lower heteroatom levels are recommended, in particular, nitrogen levels of 2 ppm or less.

The removal of these sulfur and nitrogen contaminants requires the hydrotreating stage to be upstream of the hydrocracking process. This upstream hydrotreating stage is referred to as an "R-1" hydrotreater. In the past, R-1 hydrotreaters have been designed and built for high pressure operation, in the league of 1500 psig total pressure. Such design was deemed necessary due to the difficult task of removing contaminants to the low levels required by the Hydrocracking Unit, particularly the second stage thereof comprising a sweet zone. With high pressure operation, significant aromatics hydrogenation can occur, although undesirably consuming much hydrogen and requiring large amounts of treat gas to be circulated through the unit. A large compressor has traditionally been needed, further escalating the costs of the high pressure R-1 hydrotreater.

The prior art discloses various methods for reducing hydrogen consumption in a hydrotreating or hydrodesulfurization operation. U.S. Pat. No. 4,179,355 and 4,179,354 to Frayer et al. relate to a multistage desulfurization of a residual oil, while avoiding deep, hydrogen inefficient hydrodesulfurization of the heavy portion of the oil. Frayer et al. teaches separating an interstage stream into distillate and residual components so that the downstage hydrodesulfurization stage is relieved of accomplishing relatively deep desulfurization of refractory residual components necessary to produce a low sulfur effluent stream. U.S. Pat. No. 4,592,828 to Chu et al. discloses a hydrodesulfurization process for upgrading petroleum residuum. Relatively severe conditions, for example at 1500 to 2500 psig, are preferred. A distillation unit is used for the purpose of dewaxing and producing gasoline directly. The combination of a hydrotreater with a distillation means in an integrated process generally is known. U.S. Pat. No. 3,806,444 to Crouch et al. discloses a hydrodesulfurization process for converting heavy crudes or crude fractions to liquid industrial fuels with a maximum of 1.0% sulfur. The hydrotreating is under relatively severe conditions and, in particular, the pressures are in the range of 1000 to 6000 psig. A distillation unit subsequent to the hydrotreater produces a product stream substantially free from sulfur.

BRIEF DESCRIPTION OF THE INVENTION

It has now been discovered that sufficient clean-up of a process stream for subsequent upgrading in a sweet processing stage such as a hydrocracker can be accomplished at relatively low pressure. The present process features hydrotreating of the raw process stream at total pressures of 500 psig or below and elevated temperatures, followed by a distillation or separation of the product stream into predominantly "sweet" fractions. One or more sweet fractions are hydroprocessed over a noble metal catalyst and the bottoms may be passed to a catalytic cracker. A fused iron catalyst is optionally added after the distillation step to increase the amount of product which can be sent to the sweet processing stage.

These and other objects are accomplished according to our invention, which comprises:

(1) passing a first stream comprising a petroleum distillate in admixture with a hydrogen containing gas through a hydrotreating zone and in contact with a hydrotreating catalyst under a pressure of about 500 psig or below, such that substantial hydrodesulfurization is carried out;

(2) introducing the process stream from step (1) into a fractionation zone, separating the stream into a distillate overhead stream which is substantially free from heteroatoms and a distillate bottoms stream; and (3) passing the distillate overhead stream from step (2) into a sweet processing zone containing a noble metal catalyst.

BRIEF DESCRIPTION OF THE DRAWINGS

The process of the present invention will be more clearly understood upon reference to the detailed discussion below upon reference to the drawings wherein.

DETAILED DESCRIPTION OF THE INVENTION

The present invention is directed to a process for relatively low pressure, high temperature hydrotreating of a petroleum distillate combined with a selective distillation or separation to produce a segregated product substantially free of heteroatoms. The hydrotreating is conducted at pressure and temperature conditions where heteroatom removal across the entire liquid product would otherwise not be complete. After an appropriate distillation or separation, the product fraction which is substantially free from heteroatoms can be fed to a noble metal catalyst system for further upgrading, while the product containing significant heteroatom levels can be fed to a catalytic cracker for conversion to motor gasoline. A greater ratio of sweet to dirty product can be obtained by further increasing hydrotreating temperature, or by cutting selectively deeper into the product and inserting a fused iron cleanup bed to further decrease nitrogen levels. Extending distillation under a vacuum enables the removal of additional incremental amounts of sulfur and nitrogen free light products.

In the following description of the invention, the term "petroleum distillate feed" is meant to include virgin petroleum feedstock or a distillate thereof. Materials which may be advantageously treated according to the present process include light catalytic cracker oil (LCCO), and thermally cracked distillates which have a substantial amount of aromatics and heteroatoms such as nitrogen.

The term "hydrogen containing gas" as used herein includes by definition substantially pure hydrogen, for example 90 to 97 percent by volume $H_2$, or a recycle hydrogen stream recovered subsequently in the process and containing at least 40 percent by volume hydrogen, in a hydrogen rich gas as elsewhere obtained from the processing of hydrocarbonaceous fuels and containing at least 40 percent by volume hydrogen.

Although the term "fractionator" is used herein, those skilled in the art will appreciate that this encompasses a distillation column or alternatively a high pressure separator, equivalent to a one plate distillation unit.

Figure 1:
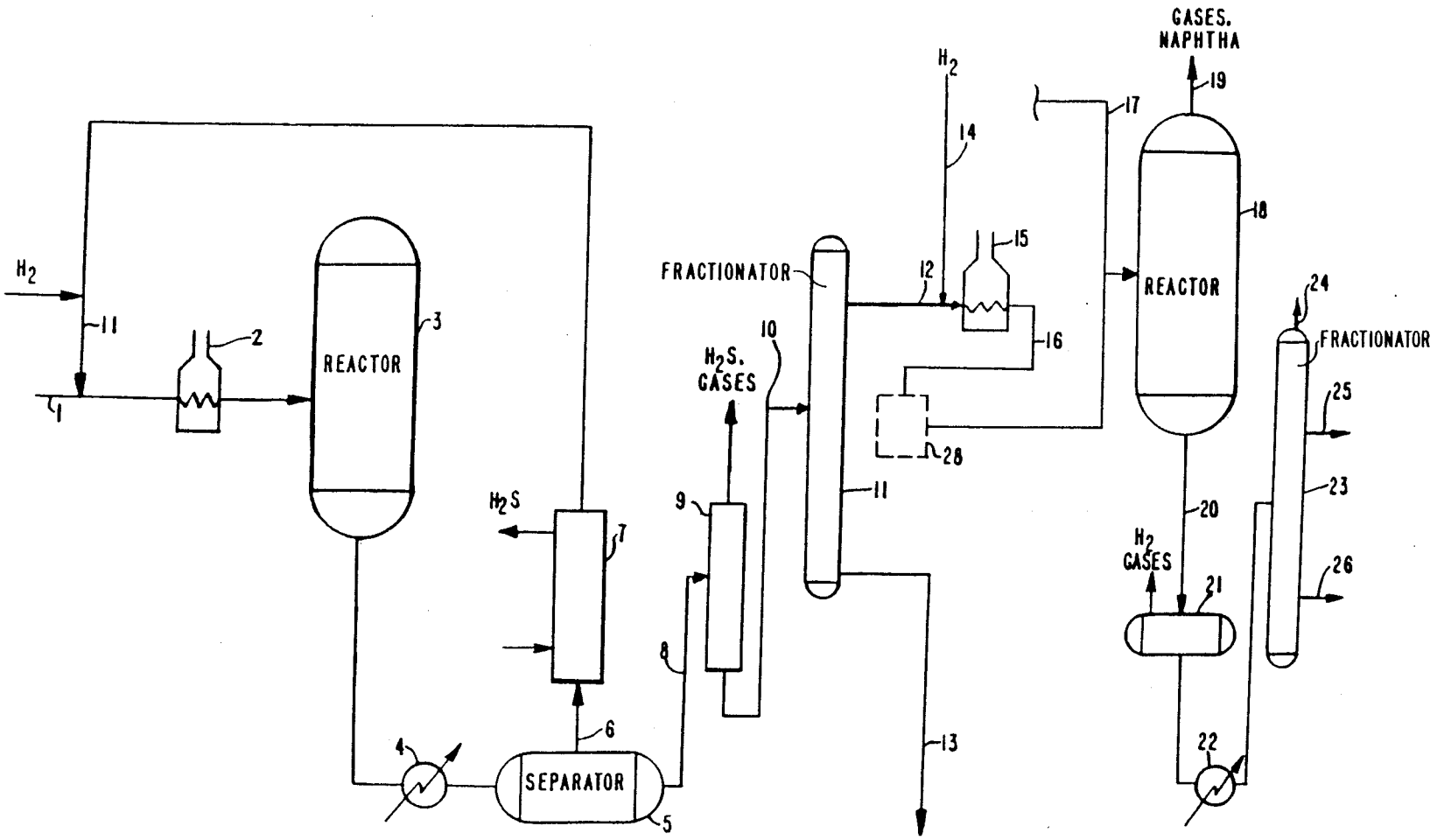
FIG. 1 shows a schematic diagram of one process scheme according to this invention where a relatively low pressure hydrotreater prepares a portion of the feedstock to a reactor employing a noble metal catalyst.

Referring to FIG. 1, a petroleum distillate feedstream 1 comprising for example virgin naphtha, enters hydrotreater reactor 3 designated R-1. Before being passed to the hydrotreater reactor 3, the feedstream is typically mixed with a hydrogen containing gas stream 21 and heated to a reaction temperature in a furnace 2. The hydrogen containing feedstream preferably passes downward through the reactor 3. Depending on the feedstock and operating conditions, all of the oil may be vaporized or as much as 80–90% may remain in the liquid phase.

The hydrotreater reactor typically contains a catalyst in the form of extrudates or pills. The possible catalysts are well known in the art and include molybdena on alumina, cobalt molybdate on alumina, nickel molybdate on alumina, nickel tungstate, or combinations thereof. Which catalyst is used may depend on the particular application. Cobalt molybdate catalyst is generally used when sulfur removal is the primary interest. The nickel catalysts find application in the treating of cracked stocks for olefin or aromatic saturation. One preferred application for molybdena catalyst is sweetening or the removal of mercaptans.

Various types of reactions occur during hydrotreating. In one type of reaction, the mercaptans, disulfides, thiophenes, benzothiophenes and dibenzothiophenes are desulfurized. The mercaptans and disulfides are representative of a high percentage of the total sulfur in lighter virgin oils, such as virgin naphtha and heating oil. Thiophenes, benzothiophenes and dibenzothiophenes appear as the predominant sulfur form in heavy virgin oils and even more in cracked stocks of all boiling ranges. Hydrotreating also removes nitrogen from various nitrogen compounds. Removal of nitrogen is much more difficult than sulfur removal; 90% desulfurization might be accompanied by only 40% nitrogen removal.

Total hydrogen consumption in the hydrotreater reactor 3 is relatively low, in the range of about 100 to 1000 SCF/B, typically 200 to 800 SCF/B, depending on feedstock and actual processing conditions. This includes hydrogen required for hydrodesulfurization, hydrodenitrogenation and saturation of aromatics and olefins. It is significantly less than the 1200 SCF/B hydrogen consumptions typically encountered in high pressure hydrotreating units. A further reduction in hydrogen consumption may be obtained at equivalent heteroatom removal by reducing the hydrotreating pressure and increasing the operating temperature.

The relatively low pressure in the R-1 hydrotreater is suitably less than about 500 psia, preferably 100 to 500 psia, and most preferably 200 to 500 psia. The temperature is suitably over 500° F., preferably 600° to 800° F. Temperatures over 800° F. are not recommended, since undesirable reforming or aromatics production may occur in addition to excessive catalyst deactivation. Temperatures are varied to meet distillate specifications and satisfy unit run length requirements. Temperature is often increased to compensate for catalyst deactivation until end-of-run.

The hydrotreating reactor effluents are typically cooled in a heat exchanger 4 and then passed to a gas-liquid separator 5. A gas stream 6 may be recycled to the feed stream 1 for retreatment. The recycled gas is usually first passed through scrubber 7 to remove the hydrogen sulfide because of the inhibiting effect of hydrogen sulfide on the kinetics of hydrotreating and also to reduce corrosion in the recycle circuit. Sometimes, when treating a light stock with a very low sulfur content, the recycle gas is not scrubbed because the $H_2S$ is at an acceptably low level.

Subsequent to the hydrotreating step, the cooled and degassed stream 8 is typically passed to a stripper 9 to remove residual $H_2S$ and other light gases. In many cases, the liquid products are given a light caustic wash to assure complete removal of $H_2S$. Small quantities of $H_2S$, if left in the product, will oxidize to elemental sulfur upon exposure to air, and will cause the product to exceed pollution or corrosion specifications.

Subsequent to the hydrotreating, the stripped stream 10 is then introduced into a fractionator 11. Fractionation is carried out to separate the inlet stream into the following fractionation products: a distillate (overhead) stream 12 which is relatively depleted in sulfur and nitrogen and a bottoms stream 13 which is relatively concentrated in such heteroatoms. Of course, additional streams may be taken for integration into other refinery operations. The distillate stream 16 is sent for further treatment to a sweet upgrading zone comprising a noble metal catalyst, as more fully explained below. The distillate may represent greater than 25 percent of the feed to the distillation unit, preferably greater than 75 percent and most preferably greater than 90 percent of the inlet feed to the fractionator 10. The bottoms stream 13 is most preferably less than 55 percent, preferably less than 25 percent and most preferably less than 10 percent of the inlet feed to the fractionator 11. A split of distillate to bottoms of greater than or equal to about 1 to 1 is possible.

The fractionator 11 may be operated at atmospheric pressure or lower. Preferably, the pressure in the fractionator may be dropped to about 25 to 100 mm Hg to obtain additional distillate of acceptably low heteroatom content.

The heavier fractions from the distillation unit typically have heteroatom levels which exceed the recommended levels for sweet upgrading. In addition, they frequently have a high concentration of multi-ring aromatic structures. This is especially true for catalytic cracker oils. Many of the aromatics have been partially saturated, since pressures and temperatures of about 500 psig and 700° F., respectively, are similar to catalytic feed hydrotreating conditions. The bottoms stream 13 comprising these heavier cuts may thus make good catalytic cracker feeds for high octane motor gasoline production. Alternatively, the bottoms stream 13 may be cooled and sent to the heavy distillate pool for further processing into light distillate. The bottoms may also be used directly as heating oil, fuel oil, or the like.

Figure 2:
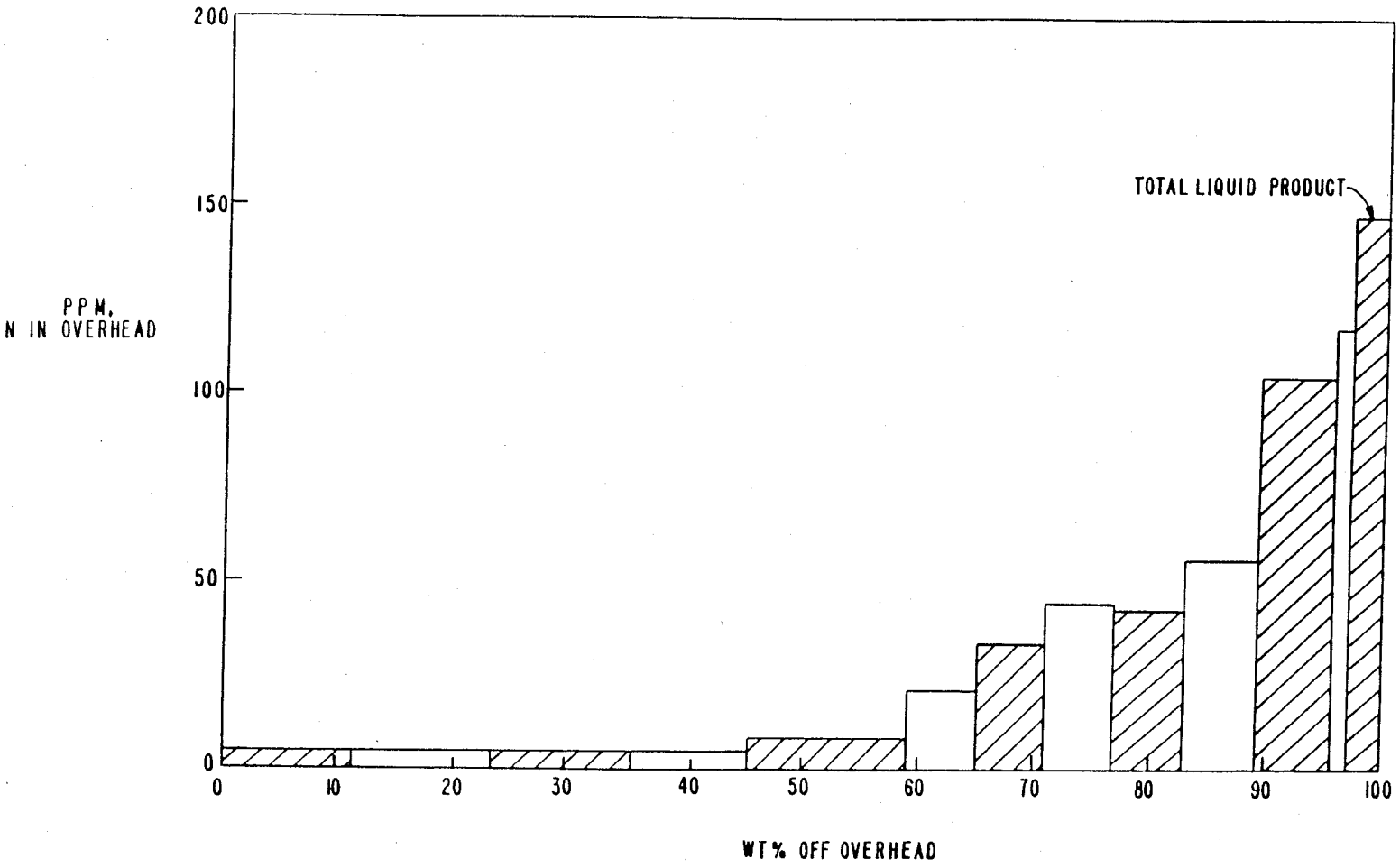
FIG. 2 contains a graph illustrating the nitrogen distribution in the overhead of a distillation unit following a hydrotreater, according to one embodiment of the present invention.
Figure 3:
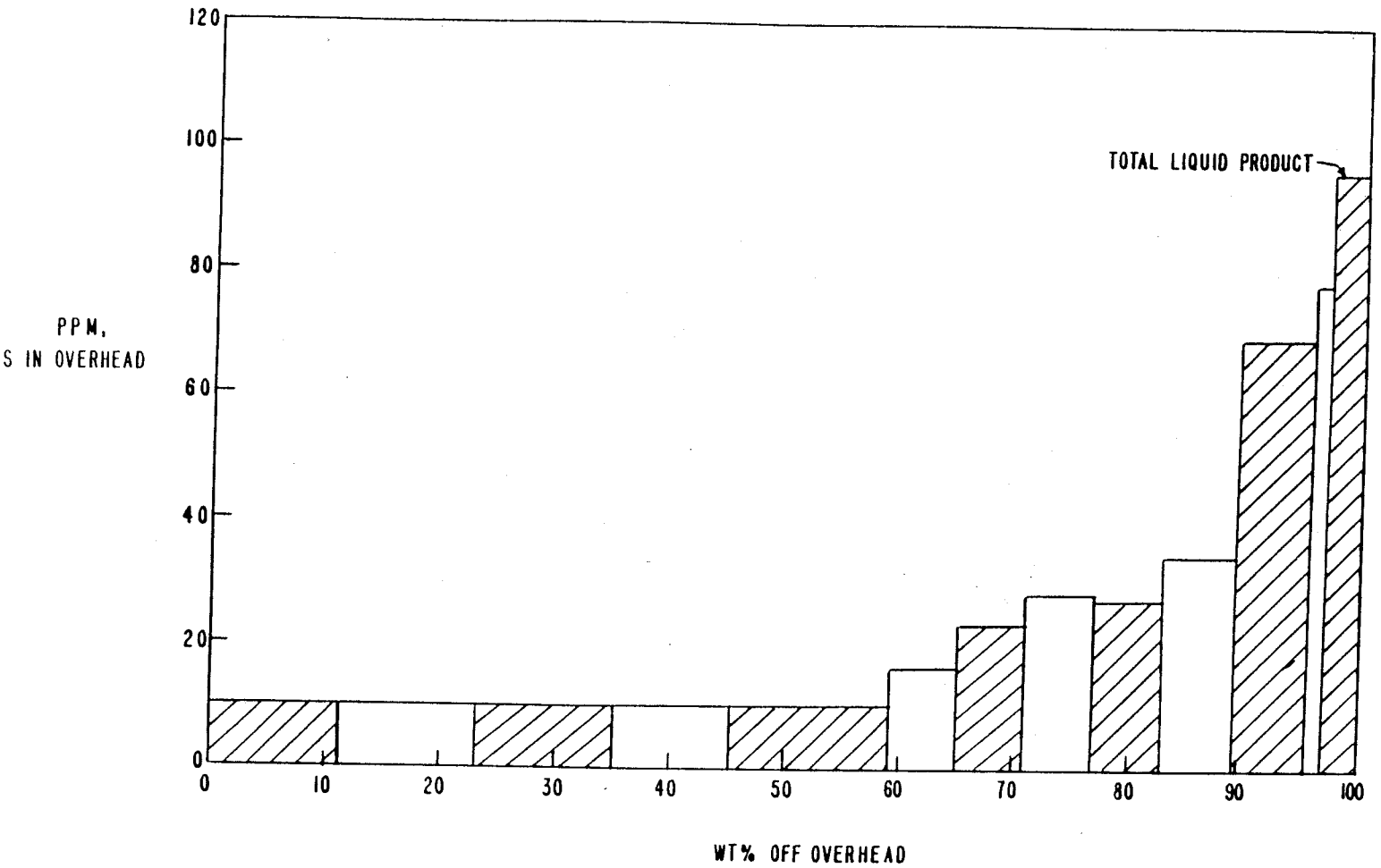
FIG. 3 contains a graph illustrating the sulfur distribution in the overhead of a distillation unit following a hydrotreater, according to one embodiment of the present invention.

FIGS. 2 and 3 show a typical distribution of sulfur and nitrogen, respectively, to be found in the fractionator overhead stream 12. As shown in FIG. 2, 45% or more of the entire product sample can be distilled overhead, resulting in a clean distillate stream with a nitrogen level of 5 ppm or less. The material also has a sulfur content which, at less than 10 ppm, is well below that required for good noble metal catalyst hydrogenation activity. Thus, greater than 45% of the entire product may be fit for hydrogenation in a sweet environment.

As shown in FIG. 3, in some cases, nearly 90% of the total liquid product (TLP) can be distilled overhead before distillate sulfur levels exceed 40 ppm. At this point, nitrogen levels will have climbed to over 50 ppm. The still relatively low sulfur content along with the absence of the tail fraction makes this part of the product an ideal stream to be processed with fused iron. Fused iron is a highly active material for hydrodenitrogenation as disclosed in U.S. Pat. No. 4,629,533, but it requires low sulfur levels, preferably less than 50 wppm, in order to function. Thus a small fused iron cleanup bed allows almost 90% of the mildly hydrotreated material to be introduced into a sweet hydrocracking or sweet hydrogenation zone. Another way to increase the yield of "sweet" product is to increase the temperature. For example, by increasing the temperature from 700° F. to 750° F., sweet product yield is typically increased from about 45% to 70%. A further increase is possible by continuing distillation under a vacuum.

The distillate stream 12 from the fractionator 11 is admixed with a hydrogen stream 14 and heated in furnace 15 to an appropriate reaction temperature. As mentioned above, the feedstream 16 may be passed through an optional fused iron cleanup bed 28 in order to further remove nitrogen therefrom prior to hydrocracking.

Also entering the hydrocracking reactor 18 can be a feed 17 treated in a relatively high pressure hydrotreater (not shown). This hydrotreater may be used to treat other feeds at a higher pressure than the relatively low pressure hydrotreater 3. A pressure of over 500 psia is currently used in the high-pressure hydrotreaters. A typical pressure is about 1500 psia. The effluent 17 from the high pressure hydrotreater is typically less than 5 ppm in nitrogen and less than 40 ppm in sulfur.

The hydrocracking reactor 18 shown in FIG. 1 can be any conventionally known system employing a noble metal catalyst. A hydrocracking reactor is primarily used for gasoline conversion. The operating conditions of the hydrocracker are flexible in response to refinery needs. For example, higher temperatures are usually employed for gasoline products as compared to jet fuels. High pressures are employed, suitably in the range of 800 to 2500 psia. Hydrogen gas at a rate of 2000 SCF/B to 5000 SCF/B must be introduced into the reactor. The temperature, pressure, and hydrogen feed may be varied to adjust to the changing feeds and intended products of the refinery.

A series of hydrocracking reactors are typically employed in a refinery. The distillate stream 12 from the fractionator may be used to back-out the current hydrocracking recycle stream which enters the most downstream hydrocracking reactor. This would free up the hydrocracker recycle stream for direct disposition into the distillate pool. Since the hydrocracker recycle stream is high in both cetane and gravity, this exchange would more effectively utilize refinery streams and at the same time help de-bottleneck the hydrocracking reactors.

The hydrocracking reactor 18 produces a gas/naphtha stream 19 and an effluent stream 20 which is typically passed to a second fractionator or distillation unit 23 via degasser 21 and cooler 22. By conventional operating conditions, the fractionator 23 yields a gaseous stream 24 comprising methane, ethane and other light gases, a gasoline stream 25, and a jet fuel stream 26. The normally gaseous components leave the top of the fractionation tower and are sent to light ends processing.

An advantage of the present invention is that the low pressure hydrotreater operating at a typical hydrogen feed rate of 750 SCF/B will be much less costly than a high pressure hydrotreater operating at a typical hydrogen feed rate of 1500 SCF/B.

By means of the process of the present invention, additional gasoline or jet fuel may be produced by a refinery at less cost and hydrogen consumption. Instead of adding to the distillate pool via further conversion reactions under relatively severe conditions, virgin crude may undergo hydrodesulfurization under relatively mild conditions prior to hydrocracking. Other advantages include reduced hydrogen consumption and reduced light gas yields.

COMPARATIVE EXAMPLE 1

A highly aromatic light catalytic cracker oil (LCCO) feedstock having a nominal boiling range of 350° to 700° F. had the following characteristics:

| | |
|---|---|
| Gravity, API | 12.7 |
| Sulfur, ppm | 15500 |
| Total Nitrogen, ppm | 493 |
| Basic Nitrogen, ppm | 42 |
| Pyrrole Nitrogen, ppm | 28.0 |
| Aniline Pt., °F. | <30.0 |
| Carbon, wt % | 89.17 |
| Hydrogen, wt % | 9.03 |
| Hydrogen by NMR, wt % | 9.01 |
| Freeze Point, °F. | −22.2 |
| Cloud Pt., °F. | 0.0 |
| Bromine Number | 20.0 |
| Refractive Index, 20° C. | 1.5765 |
| GCD, °F. | |
| IBP/5 | 321/449 |
| 10/20 | 458/492 |
| 30/40 | 503/528 |
| 50/60 | 548/578 |
| 70/80 | 608/638 |

-continued

| | |
|---|---|
| 90/95 | 669/688 |
| 99.5 | 735 |
| LV % by HPLC: | |
| Saturates | 19.9 |
| Total Aromatics | 80.1 |
| 1−Ring | 11.1 |
| 2−Ring | 51.3 |
| 3+Ring | 17.7 |

This oil was hydrotreated at conditions of 500 psig, 0.6 LHSV, 4000 SCF/B $H_2$ and a somewhat elevated operating temperature of 700° F. The catalyst used in the upgrading was a proprietary CoMo catalyst, designated RT-3 commercially available from American Cyanamid (Hartford, Conn.). Feed sulfur and nitrogen levels were 1.55 weight percent and 493 ppm, respectively.

As expected, the total liquid product (TLP) was a murky fluorescent brown color and had sulfur and nitrogen levels well above those required for satisfactory noble metal catalyst performance. Sulfur and nitrogen levels in the TLP were measured at 102 and 136 ppm, respectively.

EXAMPLE 2

The product generated in the above Comparative Example 1 was distilled via 15/5 distillation (15 theoretical plates with a 5/1 reflux ratio) into 13 narrow fractions and each fraction was analyzed for sulfur and nitrogen content. The results of these analyses are given in Table 1 below. Using the analytical results acquired on each fraction of the TLP, contaminant levels in the cumulative overhead were calculated as a function of the amount of product sample allowed in the overhead stream. The results are shown in FIGS. 2 and 3. Total hydrogen consumption during the hydrotreating step was low at 738 SCF/B. This includes hydrogen required for hydrodesulfurization, hydrodenitrogenation, and aromatics and olefins saturation.

Surprisingly, much of the product described in Comparative Example 1 is fit "as is" for introduction into the second stage of a hydrocracker which is operating in a conversion mode. Again referring to FIG. 2, almost 60% of the total liquid product (TLP) can be distilled overhead before the cumulative distillate nitrogen level exceeds 10 ppm nitrogen. Thus, nearly 60% of the product could be introduced into the second hydrocracking stage of today's commercial hydrocrackers with no ill effects on hydrocracker performance.

TABLE 1

Fractionation Results

| Cut No. | wt % of TLP | Sulfur level, wppm | N level, wppm |
|---|---|---|---|
| 1 | 0–11.3 | <10 | 5.0 |
| 2 | 11.3–23.2 | <10 | 5.4 |
| 3 | 23.2–35.1 | <10 | 4.1 |
| 4 | 35.1–45.3 | <10 | 5.3 |
| 5 | 45.3–59.0 | <10 | 23 |
| 6 | 59.0–65.0 | 80 | 144 |
| 7 | 65.0–70.9 | 100 | 166 |
| 8 | 70.9–76.9 | 80 | 155 |
| 9* | 76.9–83.0 | 20 | 36 |
| 10 | 83.0–89.3 | 130 | 222 |
| 11 | 89.3–95.8 | 540 | 774 |
| 12 | 95.8–97.2 | ~640 | 1006 |
| 13 (Bottoms) | 97.2–99.9 | 740 | 1263 |

*Distillation was continued under 100 mm vacuum at this point.

The heavier fractions from the above examples having heteroatom levels which exceed the recommended levels for sweet upgrading have a high concentration of multi-ring aromatic structures as shown in the following Table 2.

TABLE 2

Aromatics Distribution in Heavy Product Cuts

| Aromatics, LV % | LCCO Feed | Product Cut Numbers (From Table 1) 10 | 11 | 12 | 13 (bottoms) |
|---|---|---|---|---|---|
| 1-ring | 11.1 | 17.9 | 11.7 | 12.3 | 12.0 |
| 2-ring | 51.3 | 29.3 | 18.6 | 13.4 | 10.9 |
| ≧3-ring | 17.7 | 23.4 | 35.7 | 36.4 | 37.0 |
| Total aromatics | 80.1 | 71.1 | 66.0 | 62.1 | 59.9 |
| N level, wppm | 493 | 222 | 774 | 1006 | 1263 |

The process of the invention has been described generally and by way of example with reference to particular embodiments for purposes of clarity and illustration only. It will be apparent to those skilled in the art from the foregoing that the various modifications of the process and materials disclosed herein can be made without departure from the spirit and scope of the invention.

What is claimed is:

1. A process for increasing the amount of feed to a sweet processing zone, comprising:

(1) passing a petroleum distillate in admixture with a hydrogen containing gas through a hydrotreating zone and in contact with a hydrotreating catalyst at a pressure of about 100 to about 500 psia, a temperature of about 500°to 800° F., and a hydrogen feed rate of 300 to 3000 SCF/B, such that substantial hydrodesulfurization is carried out to produce a hydrodesulfurized process stream;

(2) introducing the hydrodesulfurized process stream produced in step (1) into a fractionation zone to yield a distillate bottoms stream concentrated in heteroatoms relative to a distillate overhead stream which has a sulfur content of less than 100 ppm; and (3) passing the distillate overhead stream from step (2) into a noble metal catalyst containing sweet zone for upgrading.

2. The process of claim 1, wherein the hydrotreating catalyst comprises molybdena or a metal molybdenate.

3. The process of claim 1, wherein the bottoms stream is sent to a catalytic cracker.

4. The process of claim 1, wherein the bottoms stream is sent to a heavy distillate pool.

5. The process of claim 4, wherein the effluent from the sweet zone is passed to a distillation unit, which separates the effluent into a gaseous stream and a gasoline stream.

6. The process of claim 5, wherein the sweet zone receives additional feed from an upstream hydrotreater operating at a pressure of over 500 psia.

7. The process of claim 1, wherein the sweet zone operates on a feed having a nitrogen content of less than 5 ppm and a sulfur content of less than 40 ppm.

8. The process of claim 1, wherein the noble metal catalyst containing zone is a hydrocracker.

9. The process of claim 1, wherein the percentage of distillate in relation to the feedstream is greater than 25%.

10. The process of claim 1, wherein the distillate overhead stream is passed over a fused iron cleanup bed before being introduced into said noble metal catalyst containing sweet zone.

11. The process of claim 1, wherein the amount of distillate is increased by distilling under a vacuum.

12. A process for hydrotreating a petroleum distillate at relatively low pressure for increasing the amount of feed to a hydrocracking zone, comprising:

(1) passing a petroleum distillate in admixture with a hydrogen containing gas through a hydrotreating zone and in contact with a hydrotreating catalyst under a pressure of 100 to about 500 psia, a temperature of about 500° to 800° F., and a hydrogen feed rate of 300 to 3000 SCF/B, such that substantial hydrodesulfurization is carried out to produce a hydrodesulfurized process stream;

(2) introducing the hydrodesulfurized process stream from step (1) into a fractionation zone, to yield a bottoms stream concentrated in heteroatoms relative to a distillate stream which has a sulfur content of less than 100 ppm; and (3) passing the distillate stream from step (2) into a noble metal catalyst containing hydrocracking zone, which receives additional feed from a relatively high pressure upstream hydrotreating zone operating at a pressure of 800 to 2500 psia with a hydrogen gas feed rate of 2000 SCF/B to 5000 SCF/B.

* * * * *